US011135647B2

(12) United States Patent
Browne, III et al.

(10) Patent No.: US 11,135,647 B2
(45) Date of Patent: Oct. 5, 2021

(54) ITERATIVE LEARNING CONTROL FOR PERIODIC DISTURBANCES IN TWIN-ROLL STRIP CASTING WITH MEASUREMENT DELAY

(71) Applicant: NUCOR CORPORATION, Charlotte, NC (US)

(72) Inventors: Florian Maurice Browne, III, Topeka, KS (US); George T. C. Chiu, West Lafayette, IN (US); Neera Jain Sundaram, West Lafayette, IN (US); Harold Bradley Rees, Ladoga, IN (US)

(73) Assignee: NUCOR CORPORATION, Charlotte, NC (US)

( * ) Notice: Subject to any disclaimer, the term of this patent is extended or adjusted under 35 U.S.C. 154(b) by 0 days.

(21) Appl. No.: 16/572,215

(22) Filed: Sep. 16, 2019

(65) Prior Publication Data

US 2020/0009644 A1 Jan. 9, 2020

Related U.S. Application Data

(62) Division of application No. 16/138,316, filed on Sep. 21, 2018, now Pat. No. 10,449,603.
(Continued)

(51) Int. Cl.
*B22D 11/16* (2006.01)
*B22D 11/06* (2006.01)

(52) U.S. Cl.
CPC ..... *B22D 11/16* (2013.01); *B22D 11/0622* (2013.01); *B22D 11/168* (2013.01)

(58) Field of Classification Search
CPC .... B22D 11/0622; B22D 11/16; B22D 11/168
See application file for complete search history.

(56) References Cited

U.S. PATENT DOCUMENTS 3,436,943 A 4/1969 Freedman et al.
3,574,279 A 4/1971 Smith, Jr.
(Continued)

FOREIGN PATENT DOCUMENTS

KR 20080059763 A 7/2008
WO 2012019213 A2 2/2012
WO WO-2016083506 A1 * 6/2016 ..... B22D 11/0622

OTHER PUBLICATIONS

International Search Report of corresponding PCT Application No. PCT/US18/52210 dated Nov. 30, 2018 (2 Pgs.).
(Continued)

*Primary Examiner* — Kevin E Yoon
(74) *Attorney, Agent, or Firm* — Hahn Loeser & Parks LLP

(57) ABSTRACT

A twin roll casting system where the casting rolls have a nip between the casting rolls, each roller having a circumference and a rotational period. The casting roll controller adjusts the nip between the casting rolls in response to control signals. The sensor measures at least one parameter of the cast strip. The ILC controller receives strip measurement signals from the sensor and provides control signals to the casting roll controller. The ILC controller includes an ILC control algorithm to generate the control signals based on the strip measurement signals and a time delay estimate based on circumference, rotational period, and a length of cast strip between the nip and the sensor to compensate for an elapsed time from the cast strip exiting the nip to being measured by the cast strip sensor.

17 Claims, 17 Drawing Sheets

Related U.S. Application Data

(60) Provisional application No. 62/562,056, filed on Sep. 22, 2017, provisional application No. 62/654,304, filed on Apr. 6, 2018.

(56) References Cited

U.S. PATENT DOCUMENTS

| | | | | |
|---|---|---|---|---|
| 3,764,789 | A | 10/1973 | Nara | |
| 4,727,927 | A | 3/1988 | Popik | |
| 5,486,998 | A | 1/1996 | Corso | |
| 5,520,243 | A | 5/1996 | Freeman et al. | |
| 6,085,183 | A | 7/2000 | Horn et al. | |
| 6,286,348 | B1 | 9/2001 | Sekigucki et al. | |
| 6,837,301 | B2 * | 1/2005 | Nikolovski ..... | B22D 11/0622 164/442 |
| 2006/0289142 | A1 | 12/2006 | Edwards et al. | |
| 2008/0047681 | A1 | 2/2008 | Nikolvski et al. | |
| 2009/0049882 | A1 | 2/2009 | Flick et al. | |
| 2009/0294089 | A1 | 12/2009 | Sato et al. | |
| 2010/0032128 | A1 | 2/2010 | Schlichting et al. | |
| 2012/0240651 | A1 | 9/2012 | Britanik et al. | |
| 2017/0144218 | A1 | 5/2017 | Nooning, Jr. et al. | |
| 2019/0091761 | A1 | 3/2019 | Browne, III et al. | |

OTHER PUBLICATIONS

Written Opinion of corresponding PCT Application No. PCT/US18/52210 dated Nov. 30, 2018 (7 Pgs.).
European Patent Office machine translation of KR 20080059763. generated Mar. 2, 2021 (9 pgs.).
International Search Report regarding PCT/US2020/057685, dated Feb. 19, 2021 (2 pgs.).

* cited by examiner

ITERATIVE LEARNING CONTROL FOR PERIODIC DISTURBANCES IN TWIN-ROLL STRIP CASTING WITH MEASUREMENT DELAY

This application claims priority to, and the benefit of: U.S. application Ser. No. 16/138,316 filed on Sep. 21, 2018, now U.S. Pat. No. 10,449,603 and further claims benefit of U.S. Provisional Application No. 62/562,056 filed on Sep. 22, 2017 with the United States Patent Office and U.S. Provisional Application No. 62/654,304 filed on Apr. 6, 2018 with the United States Patent Office, which are both hereby incorporated by reference.

BACKGROUND

Twin-roll casting (TRC) is a near-net shape manufacturing process that is used to produce strips of steel and other metals. During the process, molten metal is poured onto the surface of two casting rolls that simultaneously cool and solidify the metal into a strip at close to its final thickness. As the rolls rotate, angular variations in the shape and thermodynamic characteristics of the rolls can create periodic disturbances in the strip's thickness profile. One example of this is when one side of the strip is inadvertently cast thicker than the other due to a change in the relative gap distance between the rolls' edges. This disturbance is called a wedge, and its presence compromises the quality of the final strip. Compensating for this kind of disturbance, however, is complicated by the presence of large delays between the casting and the measurement of the strip.

In the past, researchers have focused on the stability of the TRC process as well as improving its overall performance. Specifically, many researchers have analyzed the interactions between various process parameters as well as how those interactions affect the steady-state behavior of the process. However, little to no work has been done to address the disturbances that occur on a per-revolution basis. Without addressing these disturbances, many of the steady-state simulations that previous authors have derived, will not be able to achieve the thickness performance objectives that they have outlined.

Due to the rotational nature of TRC, the most prominent dynamics of the roll are periodic. This makes learning-based control algorithms a desirable method for addressing the per-revolution disturbances. Iterative learning control (ILC) is a popular control technique for eliminating periodic disturbances that occur in repetitive processes. Iterative learning control leverages the repeatability of a process to eliminate the influence of periodic disturbances from the process. Originally proposed in the 1980s, ILC has been used to improve the tracking performance of a wide variety of systems in the areas of robotics, chemical processing, and manufacturing. An ILC algorithm uses the error signal(s) from the previous trials, or roll revolutions in this case, to generate modifications to the input signal that will be applied during the next trial.

Many ILC algorithms assume that there are no time delays within the process. In real-world applications, however, this is not always true. Researchers have previously developed ILC algorithms to compensate for time delays that occur within a single iteration of the process. It is shown that, under the assumptions that the delay time is fixed and that the length of the delay is less than the length of one iteration, convergence is guaranteed for small time delay estimation errors. However, these algorithms do not extend to the case of time delays that that are actually multiple iterations in length, as is the case in a variety of applications, including twin-roll steel casting. Nor do they consider the case in which the time delay is time-varying.

Due to the rotational nature of twin roll strip casting, many of the disturbances can be expressed as a function of the rotational position of the casting rolls. Due to numerous physical limitations, however, strip characterization sensors are not co-located with system actuators. As a result, time delays may exceed the duration of a single iteration of the process, i.e., one complete rotation of the casting rolls. This means that an accurate time delay estimate is needed before these measurements can be used in conjunction with feedback algorithms to control the process.

To account for the variability of the time delay, a time delay estimation algorithm is needed. The most common time delay estimation algorithms use correlation-based methods to estimate the time delay within a process. The periodicity of a process, however, makes correlation-based methods unreliable, especially when the delay is multiple periods in length. This is because the periodicity causes the correlation function to have a local maximum for every period within the search window.

SUMMARY

To overcome these fundamental challenges, a time delay estimation method for repetitive processes in which the time delay is longer than one iteration is provided herein. The method first narrows the search window for the time delay to an interval of delay values that encompasses a single period of the process. A correlation based method may then be used to find the actual delay within the smaller interval.

In particular, an ILC algorithm is described for a class of periodic or repetitive processes with a variable time-delay that is greater than one iteration in length. The delay is separated into two components: a $n_k$ component based on the number of iterations contained within a single delay period and a $\tau$ component defined as the residual between the actual delay and the $n_k$ component. This structure then enables the derivation of a stability law for ILC algorithm that is a function of the estimation error in $n_k$ and in $\tau$.

Herein, iterative learning control (ILC) algorithms are described for a class of periodic processes with a variable time-delay that is greater than one iteration in length. An example of such a process is twin-roll strip casting wherein the actuator and sensor are not co-located, thereby resulting in a significant time delay that is itself a function of process parameters such as roll speed. We separate the delay into two components: an integer component $n_k$ based on the number of iterations contained with one delay period and a second component $\tau$ defined as the residual between the actual delay and $n_k T_R$. This structure then enables the derivation of a ILC stability law that is a function of the estimation error in $n_k$ and in $\tau$. The proposed algorithm is applied to twin-roll strip casting where the $n_k$ estimate is derived based on geometric properties of the process and the r estimate is driven by standard correlation methods. The delay estimation algorithm is validated using experimental process data. Then, through simulation results we demonstrate the sensitivity of the ILC algorithm to estimation error in $n_k$ and in $\tau$ as well trade-offs in performance that arise through error in each estimate.

A twin roll casting system according to the present invention may comprise a pair of counter-rotating casting rolls, a casting roll controller, a cast strip sensor and an ILC controller. The pair of counter-rotating casting rolls have a nip between the casting rolls and are capable of delivering cast strip downwardly from the nip, the nip being adjustable, each roller having a circumference C and a rotational period $T_R$. The casting roll controller is configured to adjust the nip between the casting rolls in response to control signals. The cast strip sensor is capable of measuring at least one parameter of the cast strip, where a cast strip of length L exists between the nip and the cast strip sensor, the length L being greater than circumference C. The ILC controller is coupled to the cast strip sensor to receive strip measurement signals from the cast strip sensor and coupled to the casting roll controller to provide control signals to the casting roll controller, the ILC controller including an iterative learning control algorithm to generate the control signals based on the strip measurement signals and a time delay estimate ΔT representing an elapsed time from the cast strip exiting the nip to being measured by the cast strip sensor. The time delay estimate ΔT further comprises an iterative delay $T_I$ comprising a product of a number of roll revolutions $n_k$ and rotational period $T_R$; and a residual delay τ that maximizes correlation between control signals provided to the controller and strip measurement signals received from the sensors over a window of the iterative delay and the iterative delay plus one iteration. The ILC controller may be configured to calculate the residual delay τ, the iterative delay $T_I$ or both.

In one example, a product of the number of roll revolutions $n_k$ and circumference C provides an iterative length $L_I$, where the iterative length $L_I$ is less than length L and a difference of length L and iterative length $L_I$ is less than circumference C The number of roll revolutions $n_k$ may be least two or more. The cast strip sensor may comprises a thickness gauge that measures a thickness of the cast strip in intervals across a width of the cast strip.

The casting roll controller may further comprise a dynamically adjustable wedge controller and the nip is adjusted by the wedge controller in response to the control signals from the ILC controller. In another example, the casting rolls may include expansion rings to adjust the nip and casting roll controller may control the expansion rings in response to the control signals from the ILC controller.

The cast strip sensor may measure the cast strip for at least one periodic disturbance and the iterative learning algorithm may be adapted to decrease a severity of the at least one periodic disturbance.

A method of reducing periodic disturbances in a cast strip metal product in a twin roll casting system having a pair of counter-rotating casting rolls producing the cast strip at a nip between the casting rolls, the nip being adjustable by a casting roll controller, each roller having a circumference C and a rotational period $T_R$; may comprise measuring at least one parameter of the cast strip at a time delay $T_D$ from when the cast strip exited the nip, where the time delay $T_D$ exceeds the rotational period $T_R$, calculating a time delay estimate ΔT to compensate for time delay $T_D$, where the time delay estimate ΔT further comprises an iterative delay $T_I$ comprising a multiple of the rotational period $T_R$, and a residual delay τ that maximizes correlation between control signals provided to the casting roll controller and the measured at least one parameter over a window of the iterative delay and the iterative delay plus one iteration; providing the time delay estimate ΔT and the measured at least one parameter to an iterative learning controller; and generating control signals for the casting roll controller by the iterative learning controller based on the time delay estimate ΔT and the measured at least one parameter; wherein the casting roll controller adjusts the nip in response to the control signals from the iterative learning controller to reduce the periodic disturbances. The multiple of the rotational periods $T_R$ may be selected such that the residual delay τ is less than the rotational period $T_R$.

The parameter may comprise measurements of a thickness of the cast strip in intervals across a width of the cast strip. The casting roll controller may further comprise a dynamically adjustable wedge controller where the nip is adjusted by the wedge controller in response to the control signals from the ILC controller. The casting rolls may include expansion rings to adjust the nip and casting roll controller may control the expansion rings in response to the control signals from the iterative learning controller.

The method of claim 10, wherein the iterative learning controller is configured to calculate the residual delay τ, the iterative delay $T_I$ or both.

In either the system or method above, the entire time delay estimate ΔT to compensate for time delay $T_D$ may alternatively be calculated from the roller circumference C and the rotational period $T_R$ and at least one measured cast strip length parameter between when the cast strip exits the nip and when the cast strip is measured a time delay $T_D$ later.

The length parameter may comprise cast strip loop height. In this example, the step of calculating time delay estimate ΔT further comprises calculating a length L of cast strip between the nip and a portion of the cast strip where the at least one parameter is measured based on the loop height. The time delay estimate ΔT may further comprise an iterative delay $T_I$ comprising a multiple n of the rotational period $T_R$ where the multiple n is the greatest natural number such that the product of n and C is less than L, and a residual delay τ, where τ is estimated based on the difference of the product of n and C subtracted from L multiplied by the rotational period $T_R$ divided by L.

The foregoing and other objects, features, and advantages will be apparent from the following more detailed descriptions of particular embodiments, as illustrated in the accompanying drawings wherein like reference numbers represent like parts of particular embodiments.

DETAILED DESCRIPTION OF PARTICULAR EMBODIMENTS

Figure 1A:
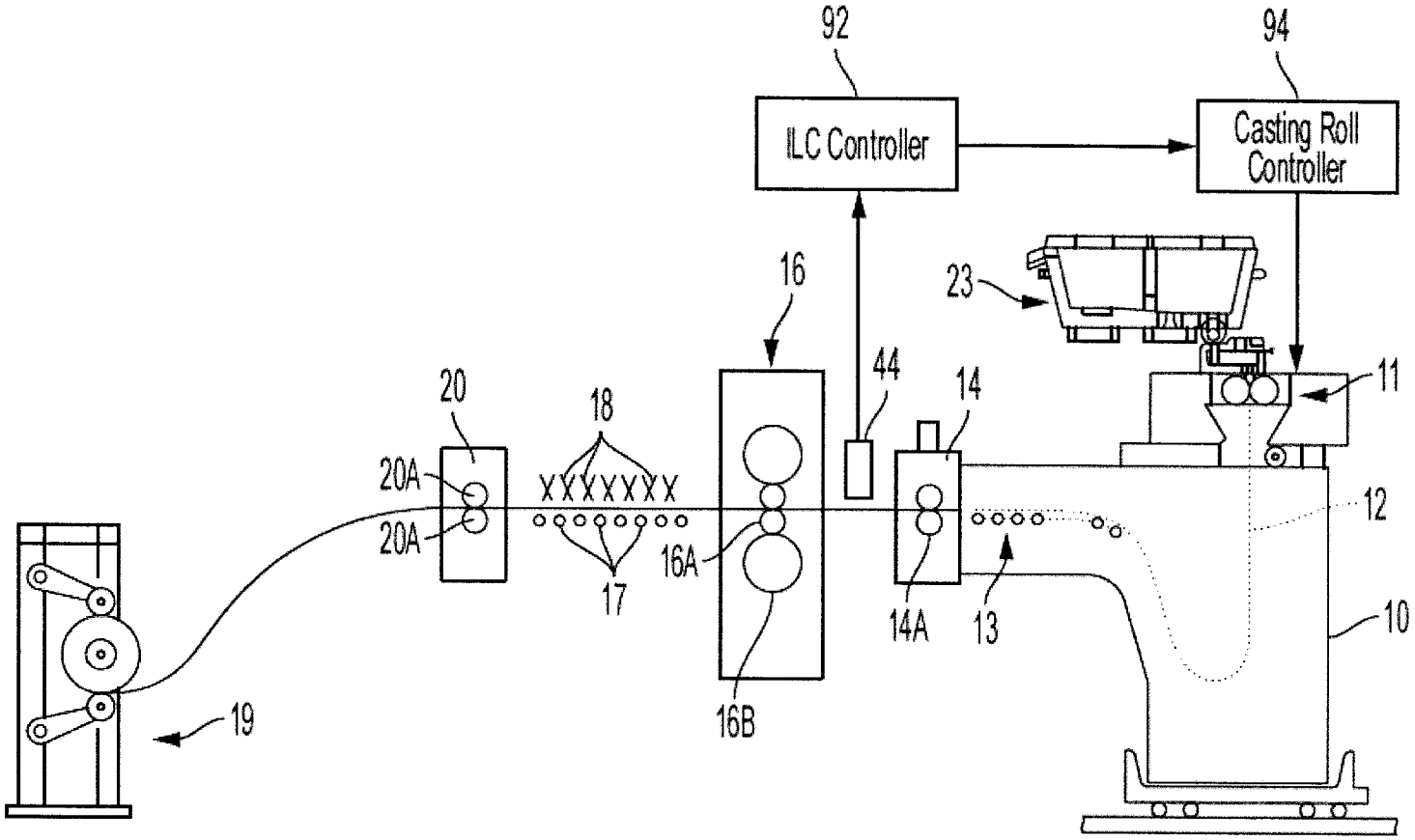
FIG. 1A is a diagrammatical side view of a twin roll caster with ILC control.
Figure 1B:
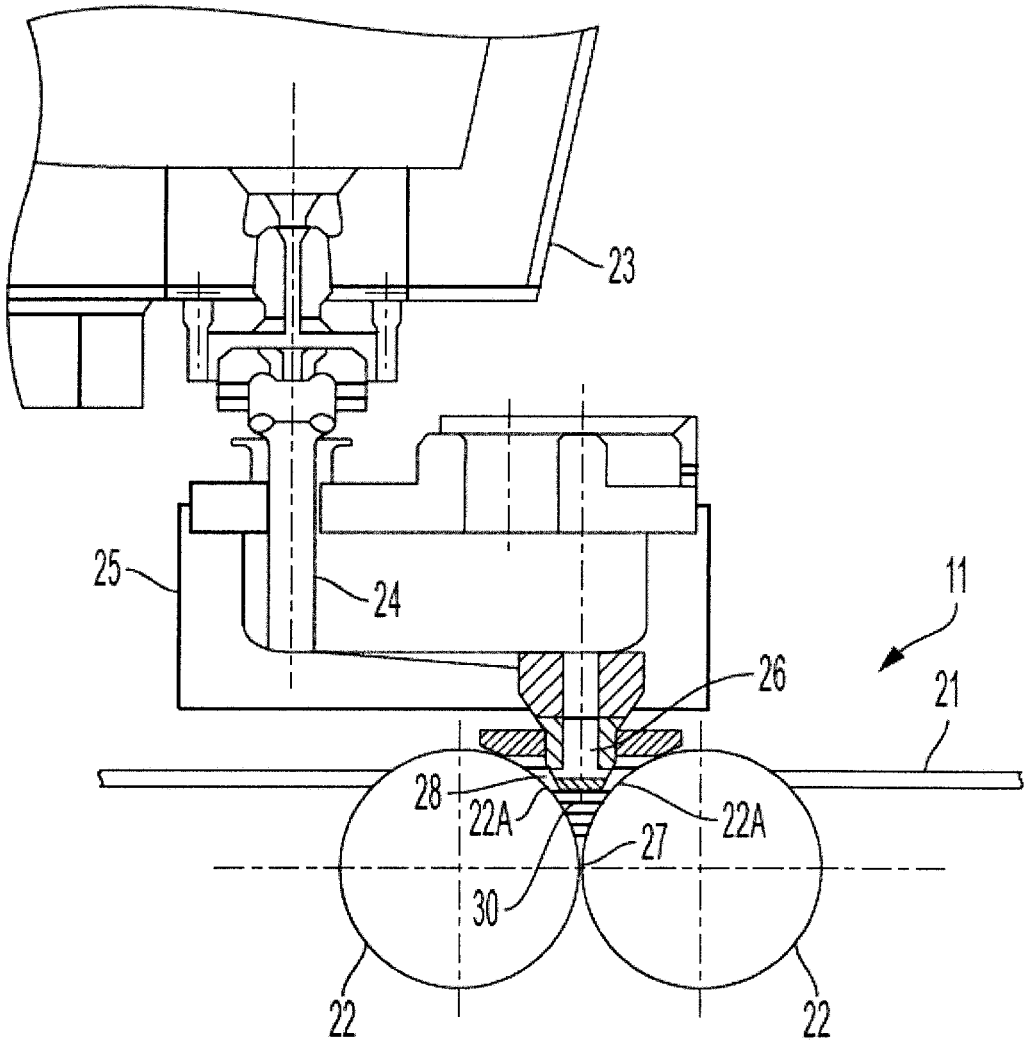
FIG. 1B is an elongated partial view of the caster of FIG. 1A.

Referring to FIGS. 1A And 1B, a twin-roll caster is denoted generally by 11 which produces thin cast steel strip 12 which passes into a transient path across a guide table 13 to a pinch roll stand 14. After exiting the pinch roll stand 14, thin cast strip 12 passes into and through hot rolling mill 16 comprised of back up rolls 16B and upper and lower work rolls 16A where the thickness of the strip reduced. The strip 12, upon exiting the rolling mill 15, passes onto a run out table 17 where it may be forced cooled by water jets 18, and then through pinch roll stand 20 comprising a pair of pinch rolls 20A and to a coiler 19.

Twin-roll caster 11 comprises a main machine frame 21 which supports a pair of laterally positioned casting rolls 22 having casting surfaces 22A and forming a nip 27 between them. Molten metal is supplied during a casting campaign from a ladle (not shown) to a tundish 23, through a refractory shroud 24 to a removable tundish 25 (also called distributor vessel or transition piece), and then through a metal delivery nozzle 26 (also called a core nozzle) between the casting rolls 22 above the nip 27. Molten steel is introduced into removable tundish 25 from tundish 23 via an outlet of shroud 24. The tundish 23 is fitted with a slide gate valve (not shown) to selectively open and close the outlet 24 and effectively control the flow of molten metal from the tundish 23 to the caster. The molten metal flows from removable tundish 25 through an outlet and optionally to and through the core nozzle 26.

Molten metal thus delivered to the casting rolls 22 forms a casting pool 30 above nip 27 supported by casting roll surfaces 22A. This casting pool is confined at the ends of the rolls by a pair of side dams or plates 28, which are applied to the ends of the rolls by a pair of thrusters (not shown) comprising hydraulic cylinder units connected to the side dams. The upper surface of the casting pool 30 (generally referred to as the "meniscus" level) may rise above the lower end of the delivery nozzle 26 so that the lower end of the deliver nozzle 26 is immersed within the casting pool.

Casting rolls 22 are internally water cooled by coolant supply (not shown) and driven in counter rotational direction by drives (not shown) so that shells solidify on the moving casting roll surfaces and are brought together at the nip 27 to produce the thin cast strip 12, which is delivered downwardly from the nip between the casting rolls.

Below the twin roll caster 11, the cast steel strip 12 passes within a sealed enclosure 10 to the guide table 13, which guides the strip to a pinch roll, stand 14 through which it exits sealed enclosure 10. The seal of the enclosure 10 may not be complete, but is appropriate to allow control of the atmosphere within the enclosure and access of oxygen to the cast strip within the enclosure. After exiting the sealed enclosure 10, the strip may pass through further sealed enclosures (not shown) after the pinch roll stand 14.

Before the strip enters the hot roll stand, the transverse thickness profile is obtained by thickness gauge 44 and communicated to ILC Controller 92. It is in this location that the wedge is measured by subtracting the thickness measurement of one side from the other. To distinguish these sides from one another, one side is designated as the drive side (DS) and the other side as the operator side (OS). Then the amount of the wedge is the DS thickness minus the OS thickness. The ILC controller provides input to the casting roll controller 94 which, for example, may control nip geometry.

Figure 2:
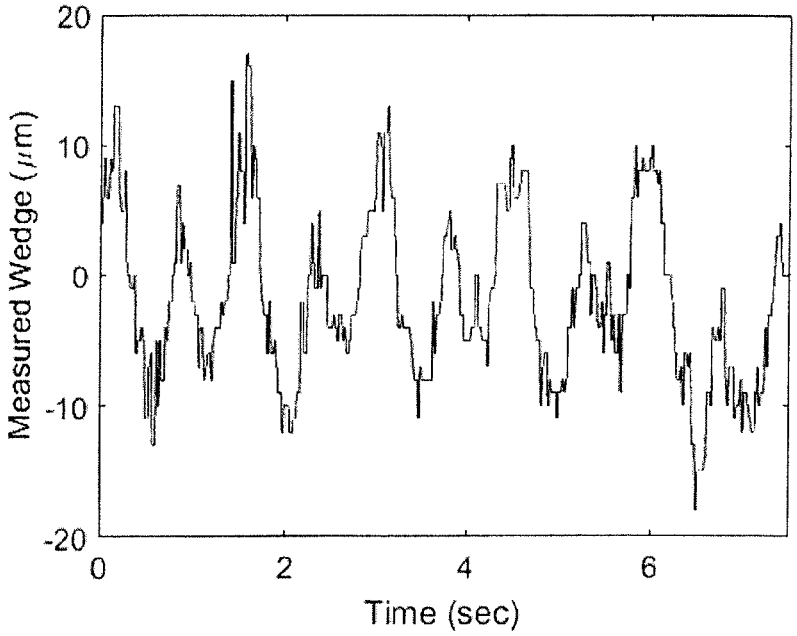
FIG. 2 is an example of the measured wedge signal for a TRC process operating with a rotational period of approximately 1.5 seconds.

In a typical cast, the wedge varies as a function of the roll's angular position. As the roll rotates, the changes in the eccentricity of the roll coupled with the thermal variations on the roll's surface can cause the wedge to shift from being biased toward one side to biased toward the other. Then, as the next revolution begins, the wedge signal reverts to being biased toward the first side and the cycle continues. An example of this type of periodic signal is shown in FIG. 2 where the rotational period is approximately 1.5 seconds. The signal in FIG. 2 displays behavior that is periodic at both the rotational frequency and twice the rotational frequency. Although the wedge signal is not purely periodic, as can be seen by low frequency variations in the amplitude of the signal, it clearly exhibits strong periodic behavior.

The main actuation variable for regulating the thickness profile is the gap created because of positioning the casting rolls. This gap is referred to as the nip. To reduce wedge defects, an ILC requires a plant model that maps how a nip reference signal affects the wedge measurement in the hot box. One control that affects wedge is "tilt", which denotes the difference between the gap distances as measured on the drive side and operator side, respectively.

Figure 3:
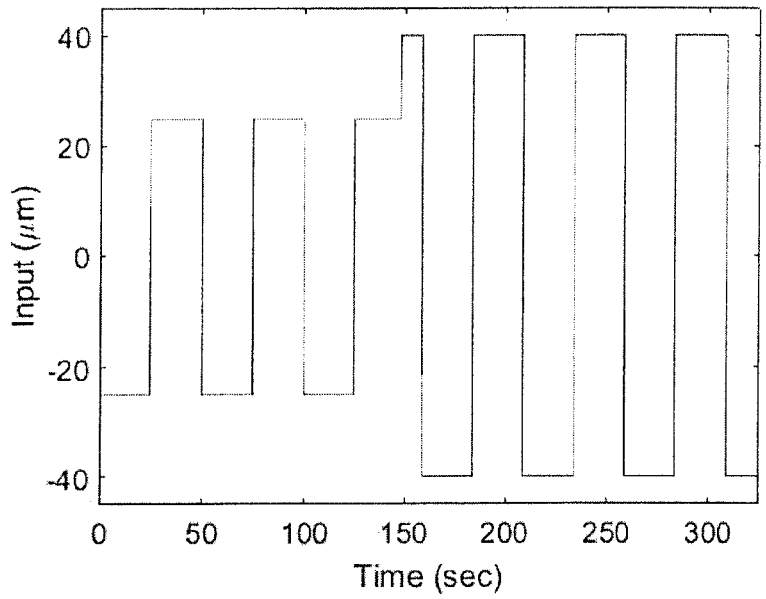
FIG. 3 shows an input signal used for system identification is a square wave applied to the tilt of the casting rolls.
Figure 4:
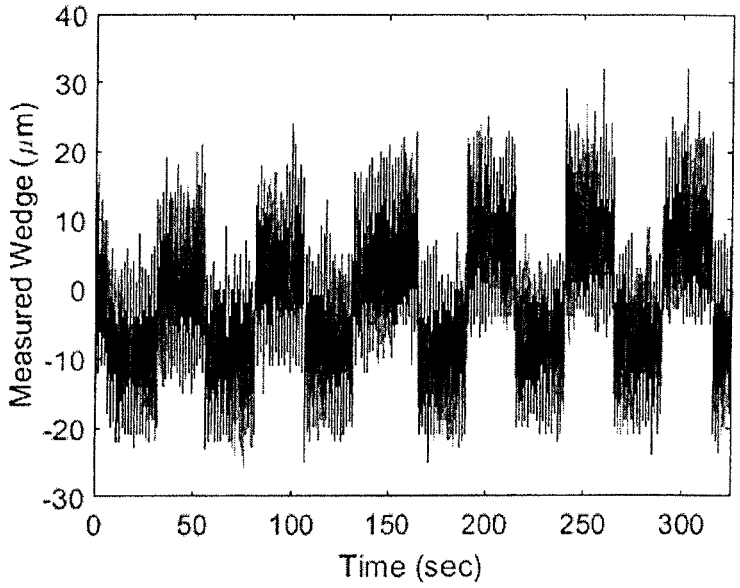
FIG. 4 shows a measured wedge signal changing in response to the input signal shown in FIG. 3.

To identify a system model, a square wave may be applied as an input tilt control signal, denoted as u and shown in FIG. 3. For an output signal cast strip thickness may be measured at the thickness gauge to measure the effect of the input tilt signal on wedge. The thickness gauge may be located on the roll out table before the hot rolling mill. The resulting wedge signal, $X_W$, is shown in FIG. 4. It is the sum of the input tilt control signal, measurement noise, and a periodic disturbance signal, as shown schematically in FIG. 5. The plant's response to the input signal is summed with measurement noise and a periodic disturbance signal to reconstruct the measured signal.

Figure 6:
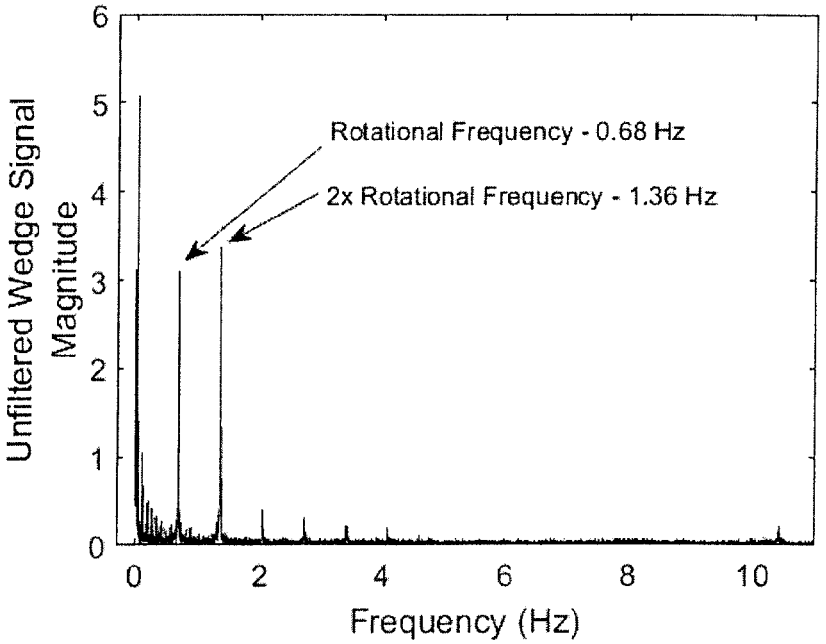
FIG. 6 shows a fast Fourier transform of the measured wedge signal with large peaks at the rotational frequency and twice the rotational frequency.
Figure 7:
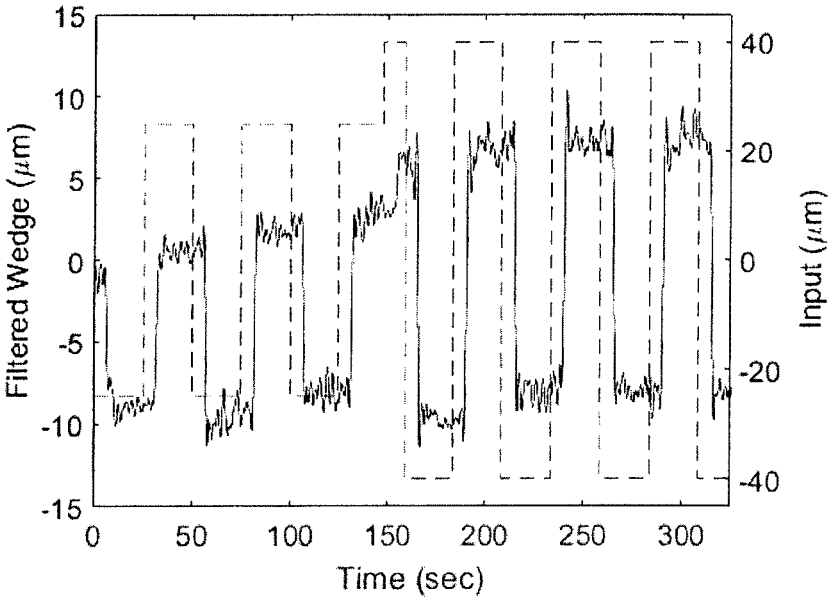
FIG. 7 shows a filtered measured wedge signal reflecting the steps in the input signal. The solid line is the filtered wedge signal and the dashed line is the input signal from FIG. 3.

The effect of the square wave is apparent in FIG. 4, but the dynamic response is masked by the presence of the disturbance and noise signals. A magnitude plot of a fast Fourier transform of the measured signal is shown in FIG. 6. There are large periodic disturbances at both the rotational frequency (0.68 Hz) and twice the rotational frequency (1.36 Hz). Significant measurement noise also exists above 1.5 Hz which can hinder the plant identification process. To reduce the effect of these signals on plant model creation, the measured signals may be filtered using a set of band-stop and low pass filters. The two periodic disturbances for example may be removed in MATLAB using the filtfilt command with two third-order, Butterworth hand-stop filters: one with cutoff frequencies at 3 rad/sec and 6 rad/sec and another with cutoff frequencies at 6 rad/sec and 10 rad/sec. The high frequency noise is then removed in a similar fashion using a sixth-order, low pass Butterworth filter with a cutoff frequency of 9 rad/sec. The resulting filtered signal is shown in FIG. 7.

In addition to the noise, the plant model identification is further complicated by the presence of a substantial delay between the tilt dynamics and the wedge measurement. As shown in FIG. 1, the strip leaves the casting rolls and enters the hot box where it forms a loop before being fed into the hot rolling stand. The wedge measurement location is downstream of the loop, on the table rolls that feed the strip into the hot roll stand. The amount of time between when the strip leaves the casting rolls and when the wedge is measured can be long enough such that multiple roll revolutions occur. To identify a plant model to be used for designing an ILC controller, the wedge signal is shifted by approximately 5 roll revolutions to compensate for this measured delay.

Figure 8:
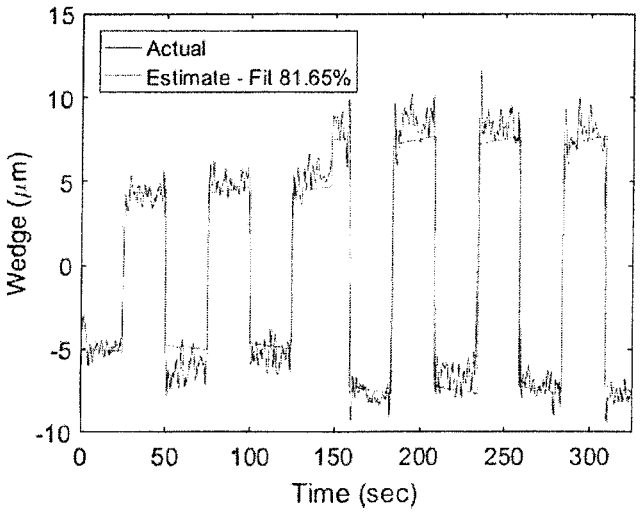
FIG. 8 shows a comparison of the estimated plant dynamics to the filtered wedge dynamics.

The filtered and wedge measurement signal, $X_{W,f}$, may then be used to identify the plant model. This is accomplished by assuming that the plant can be described by a polynomial of the form $$A(x)X_{W,f}(t)=B(z)u(t), \tag{1}$$

where t is the sample index and A and B are polynomials in terms of z, which is the forward shift operator in the t (sample) domain. As an example, a polynomial model given by $$X_{W,f}(t)=0.186z^{-671}u(t), \tag{2}$$

is able to achieve a normalized root mean square error fit percentage of 81.65% as shown in FIG. 8.

Control Design

The measurement delay discussed previously introduces a phase lag of ωT=57.3 radians which makes traditional feedback controllers practically infeasible. The identified plant model described above may be used to synthesize an iterative learning controller that can overcome the phase lag introduced by the delay. A standard ILC algorithm is given by $$u(t,k+1)=u(t,k)+Le(T,k), \tag{3}$$

where u is the tilt control input at sample t within roll revolution k and e is the error, which is defined to be the negative of the wedge signal.

Based on the plant model, the error can be rewritten as $$e(t,k)=-(B(z)/A(z)u(t,k)+D(t)), \tag{4}$$

where D(t) is the periodic disturbance signal, that does not depend on the iteration index, k. This results in a control law given by $$u(t,k+1)=[1-L(B(z)/A(z))]u(t,k)-L(z)D(t). \tag{5}$$

Then the convergence condition for the contractive mapping of u(t, k) to u(t, k+1) is given by $$\|1-L(B(z)/A(z))\|_\infty=\max_{-\pi<\omega<\pi}|1-L(B(e^{j\omega})/A(e^{j\omega}))|<1. \tag{6}$$

This mapping ensures that u(t, k) converges to a value that minimizes the tracking error. The condition is satisfied, for Eqn. (2), as long as $$0\leq L\leq 10.87$$

Equation (3) applies if there is no measurement delay. However, as discussed in the prior section, there is a significant measurement delay equal to roll revolutions. To compensate for this, we modify the controller to the form $$u(t,k+\bar{n}_k+1)=u(t,k)+Lq^{\bar{n}_k}e(t,k), \tag{7}$$

where q is the forward shift operator in the k domain and $\bar{n}_k$ is the smallest positive integer that satisfies $\bar{n}_k T_R>\Delta T$ where $T_R$ is the period of one roll revolution and ΔT is the measurement delay. This modification does not affect the gain bounds because the convergence condition becomes $$\|1-L(B(z)/A(z))\mu_\infty<1, \tag{8}$$

which results in the same bounds for L.

This type of controller can also be thought of as an ILC algorithm where the iteration period is every $\bar{n}_k$ revolutions instead of on a per-revolution basis.

Figure 5:
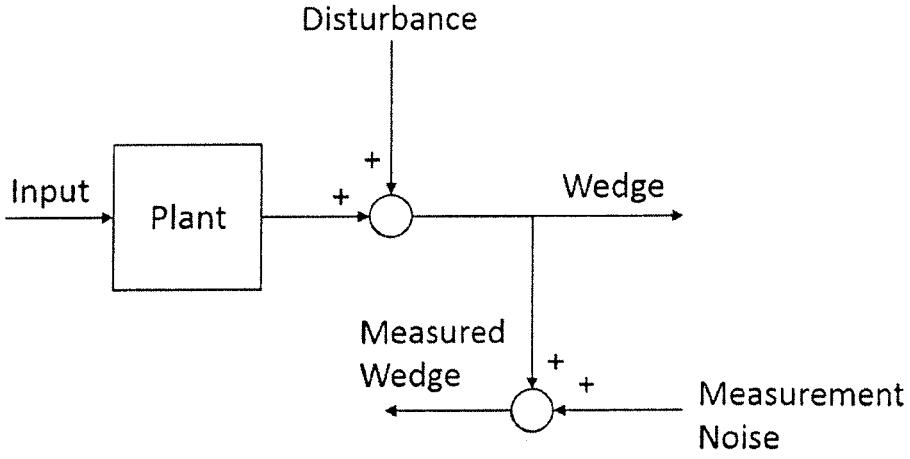
FIG. 5 shows a measured wedge signal composed of the plant's response summed with a periodic disturbance and measurement noise.
Figure 9:
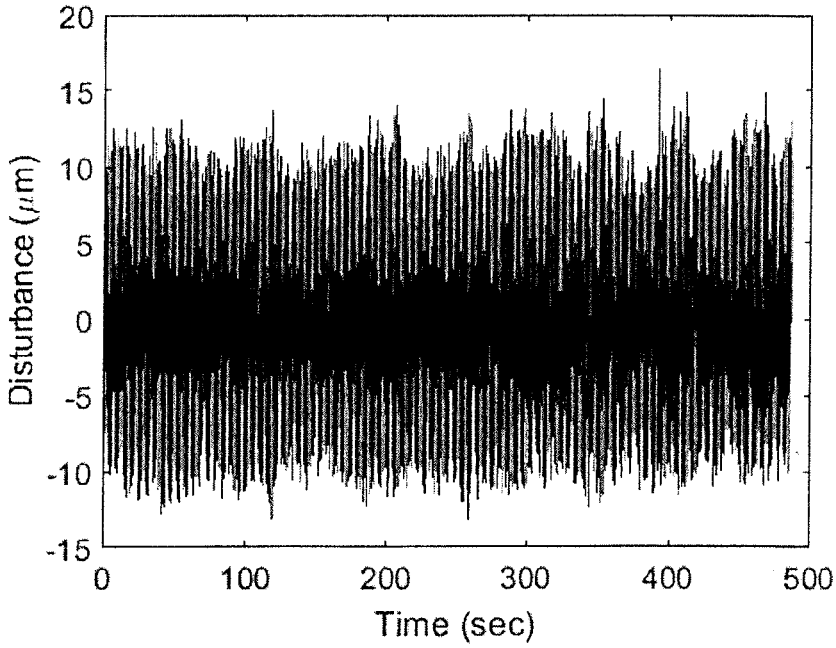
FIG. 9 shows a disturbance signal affecting the plant.
Figure 10:
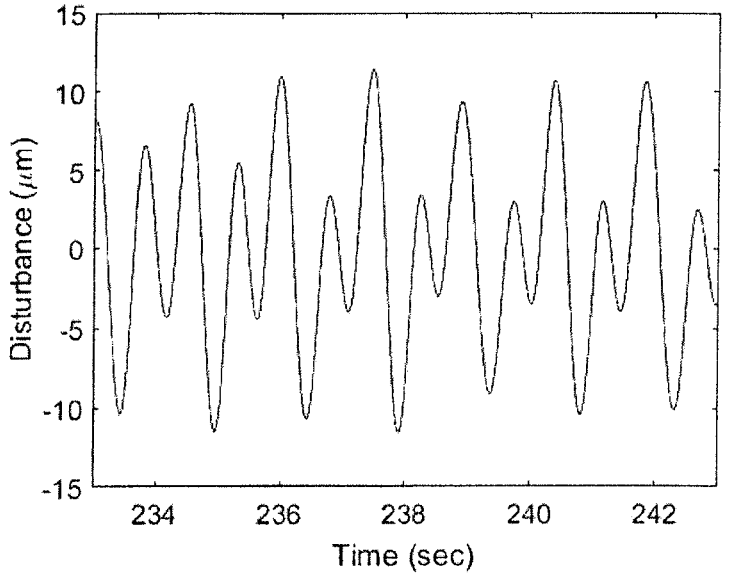
FIG. 10 shows an enlarged view of the disturbance signal.
Figure 11:
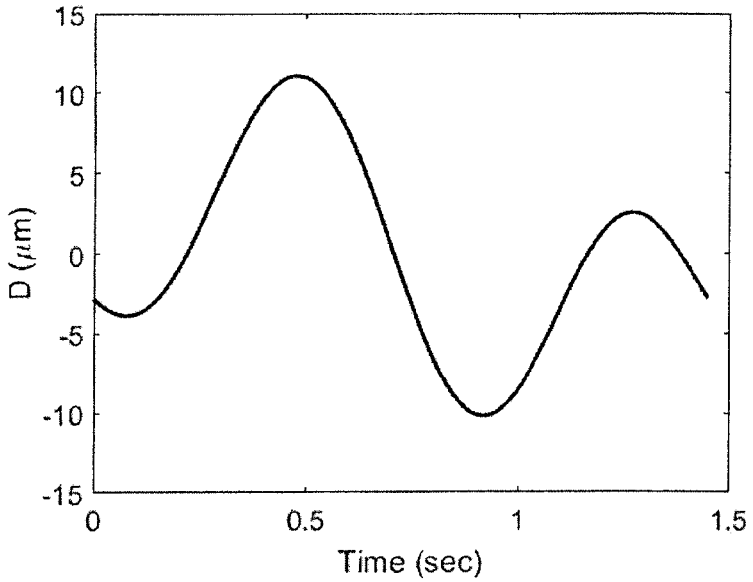
FIG. 11 shows a wedge signal during the period of one roll revolution.

The performance of the controller of Eqn. (7) was simulated on the plant model identified above with $\bar{n}_k=5$ and a disturbance signal applied to the plant output as shown in FIG. 5. The disturbance signal may be constructed by subtracting the band-stop filtered wedge signal from the unfiltered wedge signal. The resulting signal is shown in FIG. 9 with a zoomed-in view in FIG. 10. The signal shows some repeatability, but there is also some aperiodic behavior. Performance is simulated first with a strictly periodic disturbance signal by constructing such a sinusoidal disturbance with frequencies at 0.68 and 1.36 Hz, as shown in FIG. 11.

Figure 12:
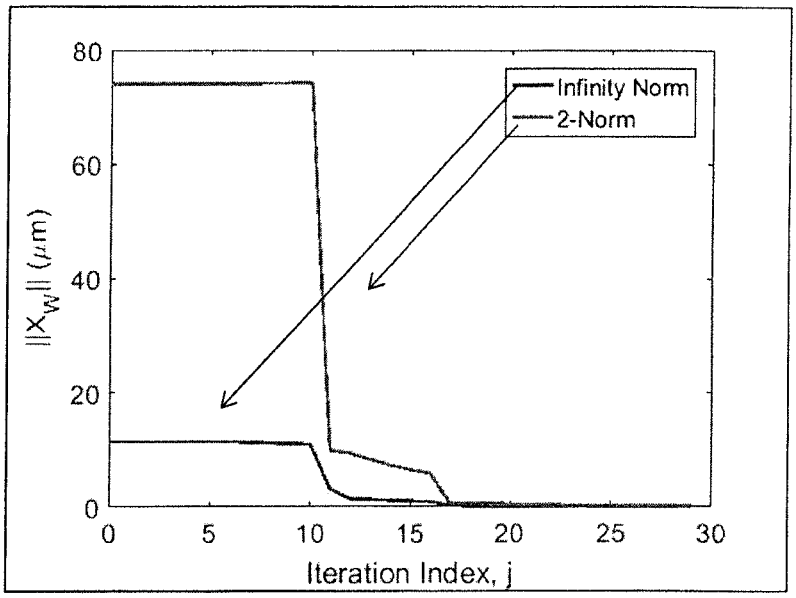
FIG. 12 shows a norm of the wedge signal after the ILC algorithm is applied to the plant with a strictly periodic disturbance.

Then, using the controller set forth above, with L(z)=5, results in the reduction of the wedge signal by a factor of 2800 (in a 2-norm sense) after 25 roll revolutions as shown in FIG. 12. The ILC control input signal quickly converges to its optimal value, and the error signal converges to zero.

Figure 13:
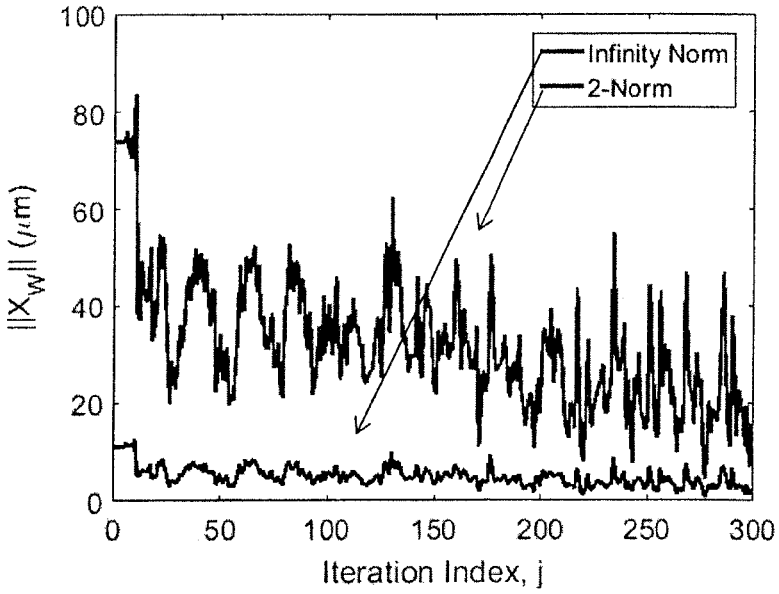
FIG. 13 shows a norm of the wedge signal after the ILC algorithm is applied to a system where D has some aperiodic behavior similar to the real process.
Figure 14:
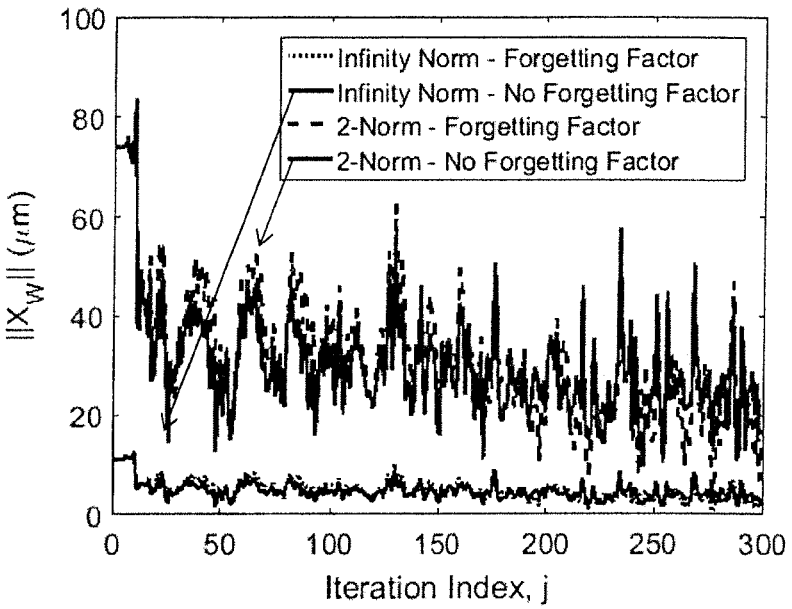
FIG. 14 shows a norm of the wedge signal after the ILC algorithm and a forgetting factor is applied to a system where D has some aperiodic behavior similar to the real process.

Even if no compensation is explicitly provided for the aperiodic behavior, a controller with L(z)=5 can still achieve a significant reduction in the error signal as shown in FIG. 13. By combining such a controller with a forgetting factor, even larger reductions in error signal may be achieved, as shown in FIG. 14. In this example, Eqn. (9) is modified to be $$u(t,k+\bar{n}_k+1)=0.8u(t,k)+L(z)q^{\bar{n}_k}e(t,k),$$

where 0.8 is a forgetting factor applied to the previous input signal. On average, this modified algorithm achieves better performance than the previous case that did not include a forgetting factor. In summary, the ILC algorithm can reduce the 2-norm of the wedge by approximately a factor of 2, even in the presence of an aperiodic disturbance signal.

The foregoing models were developed with an estimated time delay of 5 iterations. However, in a practical application, such as a twin roll casting system, the delay may vary with operating conditions, such as temperature (and expansion) of the cast strip. Accordingly, a time delay estimated is required. Common time delay estimation algorithms use the correlation between two signals to estimate the delay between them. The general concept is that given two signals x(t) and y(t), where x(t) is a delayed representation of y(t), the algorithm searches for a delay, ΔT, that when applied to x(t), maximizes the correlation between x(t+ΔT) and y(t). However, the present system involves time delays that are longer than the period of one process iteration. This means that a correlation-based delay estimation methodology would have to search through multiple periods of the process, thereby resulting in multiple regions of high correlation and multiple potential delay estimates.

However, the performance of a control system is not guaranteed when there is an error in the delay estimate. Specifically, an ILC algorithm may cause instability if the control input signal is defined by an incorrect, or delayed, error signal. More specifically, a delay estimation error would result in a phase error in the control law.

A general ILC control law may be employed to illustrate how the phase error may cause stability issues in the ILC algorithm:

$$u(t,k+1)=u(t,k)+\delta u(e(t+1,k)), \tag{9}$$

where u is the control input signal and δu is a correction factor in terms of the error signal, e. The indices t and k are the sample index and the iteration index, respectively. It is assumed that the indexing for the error signal and the control input signal are not perfectly aligned. The error signal, in the case where the desired output is zero, is defined by $$\begin{aligned} x(t+1) &= Ax(t)+Bu(t) \\ y(t) &= Cx(t-\Delta T) \\ &= C(zI-A)^{-1}Bu(t-\Delta T)+D(t-\Delta T) \\ &= Gu(t-\Delta T)+D(t-\Delta T) \\ e(t) &= 0-y(t) \\ &= -Gu(t-\Delta T)-D(t-\Delta T) \end{aligned} \tag{10}$$

where x is the delayed state measurement, ΔT is the time delay between the control input signal and the measured output signal, D(t−ΔT) is the delayed free response of the system to the initial condition of x, and A, B and C are appropriately dimensioned state space matrices. To account for the periodicity of the process, a model of ΔT may be defined as $$\Delta T(t)=n_k(t)T_R+\tau(t), \tag{11}$$

where $T_R$ is the period of one iteration, $n_k(t)$ is the number of iterations that occur during the delay, and τ(t) is the residual of $\Delta T(t)-n_k(t)T_R$. In this example, the product of $n_k$ and $T_R$ comprises an iterative time delay $T_I$ This definition allows $n_k$ and τ to be estimated separately. The estimate of $n_k$ narrows the interval of possible delays to $[n_kT_R, (n_k+1)T_R]$ and the τ estimate is the value from that interval that maximizes the correlation between the input signal and the output measurement.

Using Eqns. (10) and (11), the control law in Eqn. (9) can be rewritten as $$\begin{aligned} u(t,k+1) &= u(t,k)+\delta u(-Gu(t-\Delta T,k)-D(t-\Delta T,k)) \\ &= u(t,k)+\delta u(-Gu(t-\tau,k-n_k)-D(t-\tau,k-n_k)) \end{aligned} \tag{12}$$

The mixed indices of u on the right hand side of Eqn. (12), however, can lead to problems because the controller modifies u(t, k+1) without knowledge of how u(t, k) actually affected the process. To address this misalignment, the control law may be modified so that the control signal being defined is based on a prior control signal and the error generated by it. In this modification, alignment of the control signals should be maintenance in the time domain for continuity between iterations, so the left hand side of Eqn. (12) may be modified to $u(t, k+\bar{n}_k+1)$, where $\bar{n}_k$ is the smallest positive integer that satisfies $\bar{n}_kT_R>\Delta T$. The estimate of ΔT is then used to align the error signal with u(t, k). This results in a control law given by $$u(t,k+\bar{n}_k+1)=u(t,k)+\delta u(-Gu(t+\hat{\tau}-\tau,k+\hat{n}_k-n_k)-D(t+\hat{\tau}-\tau,k+\hat{n}_k-n_k)),$$

where $\hat{\tau}$ and $\hat{n}_k$ are the estimates of the components of ΔT. The term δu may be defined as a linear function of e. A forgetting factor, Q, may be included to modify u(t, k). This results in $$u(t,k+\bar{n}_k+1)=Qu(t,k)+K(-Gu(t+\hat{\tau}-\tau,k+\hat{n}_k-n_k)-D(t+\hat{\tau}-\tau,k+\hat{n}_k-n_k)), \tag{13}$$

where K is the learning gain. By introducing a forward shift operator z in the t-domain, and a forward shift operator q in the k-domain, Eqn. (13) may be rewritten as $$q^{\bar{n}_k+1}u(t,k)=(Q-KGq^{\bar{n}_k-n_k}z^{\hat{\tau}-\tau})u(t,k)-Kq^{\hat{n}_k-n_k}z^{\hat{\tau}-\tau}D(t,k). \tag{14}$$

The system is stable if there exists Q>0 and K>0 such that $$\|Q-KGq^{\hat{n}_k-n_k}z^{\hat{\tau}-\tau}\|<1 \tag{15}$$

Establishing this is a special case of Theorem 2 as provided in Bristow, D. A., Tharayil, M., and Alleyne, A. G., 2006, "A survey of iterative learning control," *IEFF Control Systems,* 26(3), June, pp. 96-114. By substituting q=exp(iω) and z=exp(iω) into Eqn. (15), where $\Omega=\omega T_R$ and ω is a frequency variable, we obtain $$\|Q-KG\exp(i\Omega(\hat{n}_k-n_k))\exp(i\omega(\hat{\tau}-\tau))\|<1,$$

which is to say that the system is stable as long as there exist Q>0 and K>0 that satisfy the expression for all $\omega\in\mathbb{R}$ .+

Figure 15:
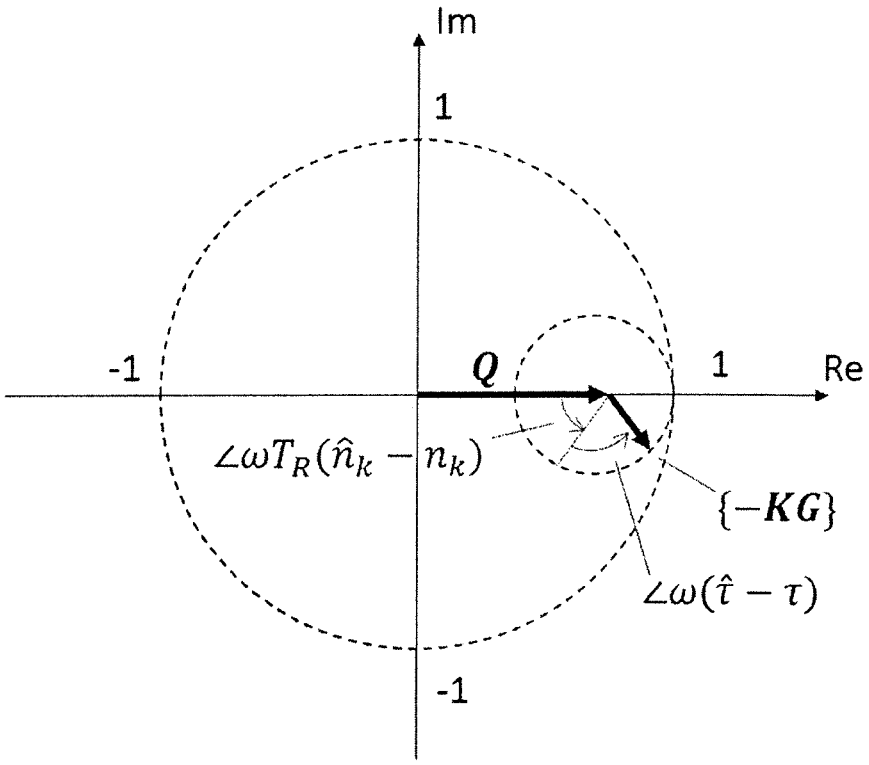
FIG. 15 is a plot showing how, for SISO systems, Eqn. (15) can be expressed as the summation of vectors in the frequency domain.

For a single-input single-output (SISO) system, Eqn. (15) may be expressed as a summation of vectors in the frequency domain as shown in FIG. 15, The time delay estimation error is equal to the phase angle of a vector with magnitude KG. A special case that may arise is that in which the number of iterations within the delay is known—in other words $\hat{n}_k=n_k$—while there is uncertainty in $\tau$, for example due to limitations in sampling rate.

For a SISO system, if $\hat{n}_k=n_k$ and all of the estimation error is due to the $\tau$ estimate, the system is stable as long as there exist Q>0 and K>0 such that $$[Q-KG\cos(\omega(\hat{\tau}-\tau))]^2+[-KG\sin(\omega(\hat{\tau}-\tau))]^2<1,$$

for all $\in\mathbb{R}$.

For SISO systems where $\tau$ is known and $n_k$ is unknown, an equivalent inequality to the one stated above may be obtained by substituting $T_R(\hat{n}_k-n_k)$ for $\hat{\tau}-\tau$. The resulting inequality and its counterpart describe the effect that estimation errors in $\tau$ and $n_k$, respectively, have on the stability of the controller.

When there is non-zero delay estimation error, it can be shown that the ILC algorithm is only stable if Q<1. The error signal, however, cannot converge to zero when Q<1. For a stable controller, the asymptotic error of the system is given by $$\|e(t,\infty)\| = \lim_{k\to\infty}\|e(t,k)\| = \lim_{k\to\infty}\left\|\left(I-G\left(q^{n_k+1}I-Q+KGq^{\hat{n}_k-n_k}z^{\hat{\tau}-\tau}\right)^{-1}Kq^{\hat{n}_k-n_k}z^{\hat{\tau}-\tau}\right)D(t)\right\| = \left\|\left(I-G\left(I-Q+KGz^{\hat{\tau}-\tau}\right)^{-1}Kz^{\hat{\tau}-\tau}\right)D(t)\right\|. \tag{16}$$

Note that the asymptotic error is not dependent on the $n_k$ estimation error. However, as shown below, the $n_k$ estimation error influences the transient behavior of the system.

For a stable SISO system with a sinusoidal output disturbance at the frequency w, Eqn. (16) can be reduced to the following sensitivity function from ||D(t)|| to ||e(t, ∞)||:

$$\|e(t,\infty)\| = \frac{(1-Q)\|D(t)\|}{[(1-Q)^2+K^2G^2+2(1-Q)KG\cos(\omega(\hat{\tau}-\tau))]^{1/2}}.$$

This expression provides a convenient way to calculate the norm of the asymptotic error of the system given the values of Q, K, and $\hat{\tau}-\tau$. Note that the effect of the disturbance on the norm of the asymptotic error is attenuated only if $$\cos(\omega(\hat{\tau}-\tau)) > -\frac{KG}{2(1-Q)}. \tag{17}$$

This provides a bound on how much delay estimation error can be tolerated before the error from the disturbance signal is amplified.

The above delay estimation algorithm, may be applied to the problem of reducing strip wedge in the twin roll strip casting process which occurs when one side of the strip is thicker than the other. In twin roll strip casting, molten steel is poured on the surface of two casting rolls where it solidifies into a strip of steel. The casting process, however, is subject to a variety of periodic disturbances that affect the uniformity of the strip thickness. These disturbances occur because of how the roll surface interacts with the molten pool and how large the actual gap is between both sides of the casting rolls. Modeling the effect of these disturbances on the plant dynamics is extremely difficult due to the high level of parameter uncertainty associated with the solidification process, including the grade of steel, the roll surface texture, etc. Nevertheless, by virtue of the process dynamics being driven by the rotational motion of casting rolls, there is a natural periodicity in the process that lends itself to a learning-based controller that modulates the casting roll position to cancel out the effect of the disturbances. The learning, however, is complicated by the presence of a large measurement delay.

Figure 29:
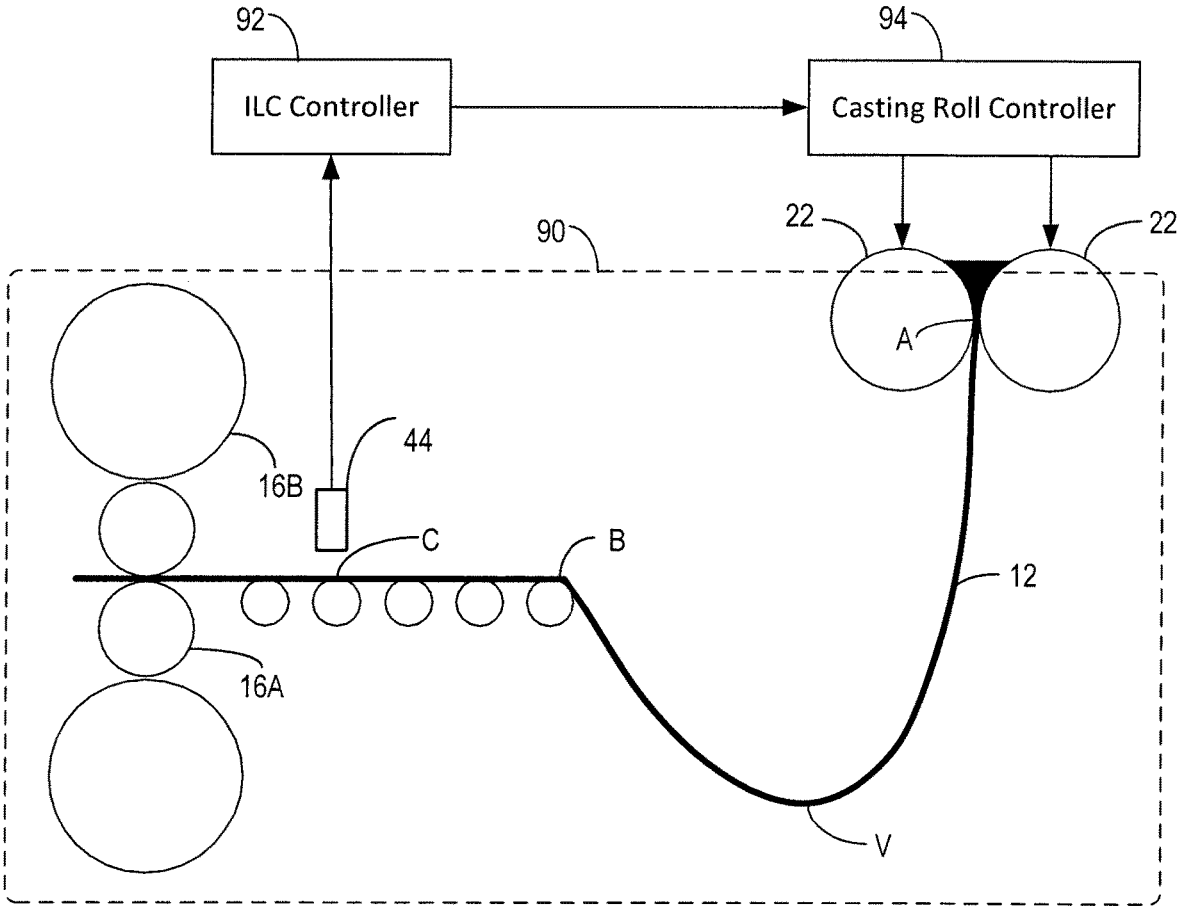
FIG. 29 is a simplified view of a twin roll caster illustrating cast strip length between the nip and a measurement location.

As shown in FIG. 29, after the strip has formed, it passes into an environmentally controlled box 90, called a hot box, where it continues to passively cool before being compressed to its final gauge through a hot roll stand. Within the hotbox, the strip is moved onto a set of table rolls that guide the strip into the hot rolling stand. The strip thickness measurements are obtained while the strip is moving along the table rolls. The measurement delay is the amount of time that it takes for the strip to move from the actuation point at the nip of the casting rolls, point A, to the measurement location, point C.

Before the strip is placed on the table rolls, it passes through a section of the hot box where it forms a free hanging loop, shown in FIG. 1 as the length of strip between points A and B. The depth of this loop is variable and depends on a number of parameters, including the casting roll speed, the hot rolling stand speed, and the grade of steel being cast. A sensor can be used to estimate the depth of the vertex relative to the nip of the casting rolls, $y_A-y_V$. This measurement, in conjunction with the known distances between the nip of the casting rolls (point A), the start of the table rolls (point B), and the measurement location (point C), can then be used to estimate the amount of steel between points A and C. From that estimate, we can obtain the time delay using the casting speed.

As noted below, the periodic nature of the process makes it well suited for learning-based control algorithms. This periodicity, however, complicates the use of correlation methods for estimating the delay online. Based on the definition of the time delay that we introduced in Eqn. (11), the estimation of $\Delta T$ may be divided into two separate estimation problems: a $n_k$ estimate that narrows the search window of the time delay to the span of one roll revolution, and a $\tau$ estimate that uses a correlation-based algorithm to search through the reduced window to determine the time delay estimate.

The basic concept for the $n_k$ estimation algorithm is to relate $n_k$ to the length of the strip between the casting rolls and the measurement location. The length of the strip may be expressed as:

$$L=n_kC_{CR}+\delta L, \tag{18}$$

where $C_{CR}$ is the circumference of a single casting roll and $\delta L$ is the remainder of $L/C_{CR}$. As shown in FIG. 1, the length of the strip is divided into two sections: 1) a catenary curve between the nip of the casting rolls (point A) and the first table roll (point B), and 2) the length of the strip on the table rolls between point B and point C.

The length of the strip between B and C is fixed by the geometry of the hot box, $x_C-x_B=\bar{x}_{BC}$. The value of $n_k$ can vary, however, because of the expansion and contraction of the loop within the hot box. In other words, $n_k$ will vary based on the length of the strip between points A and B in FIG. 1.

The distances between A and B are fixed: $x_B-x_A=\bar{x}_{AB}$ and $y_A-y_B=\bar{y}_{AB}$. By assuming that the loop is a catenary curve, the equation of the curve is given by $$y = a\cosh\left(\frac{x}{a}\right), \tag{19}$$

where x and y are defined such that the x coordinate of the vertex of the curve, $x_V$, is at x=0. The term a>0 is a parameter of the curve and is related to the material that forms the curve. The arc length of the curve may then be expressed as $$s = a\sinh\left(\frac{|x_B|}{a}\right) + a\sinh\left(\frac{|x_A|}{a}\right). \tag{20}$$

The length of the strip may then be rewritten as $$L = s + \bar{x}_{BC} \tag{21}$$

In order to solve Eqn. (21), a must be determined. This may be done by solving the following system of equations:

$$y_A = a\cosh\left(\frac{x_A}{a}\right), \tag{22}$$

$$y_B = a\cosh\left(\frac{x_B}{a}\right), \tag{23}$$

$$x_B - x_A = \bar{x}_{AB}, \tag{24}$$

$$y_A - y_B = \bar{y}_{AB}, \tag{25}$$

$$y_A - h_{Loop} = a\cosh(0) = a, \tag{26}$$

where $h_{Loop}$ is the measured loop depth relative to the nip ($h_{Loop}=y_A-y_V$) The value of a is then the solution to $$\bar{x}_{AB} = a\cosh^{-1}\left(\frac{a + h_{Loop}}{a}\right) + a\cosh^{-1}\left(\frac{a + h_{Loop} - \bar{y}_{AB}}{a}\right). \tag{27}$$

Figure 16:
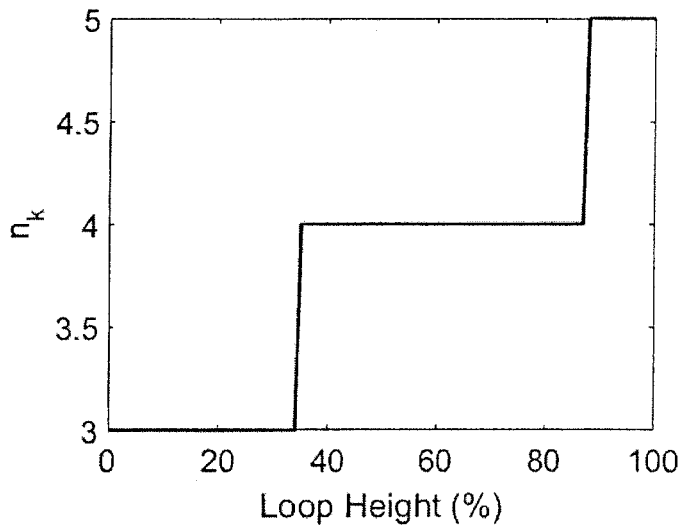
FIG. 16 is a chart showing the relationship between the normalized loop height measurement and $n_k$ using the relationship defined in Eqn. (28)

Computationally, calculating a and, subsequently, L, may require more time than can be allocated to the task. This may be avoided, however, by creating a mapping of $h_{Loop}$ directly to $n_k$ Given that the diameter of the casting rolls is L, the circumference of a roll, and equivalently the length of strip produced in one roll revolution, is $L_k=C_{CR}=\Delta D$. Then $n_k$ can be calculated from Eqn. (18) as $$n_k = \text{floor}(L/L_k), \tag{28}$$

where L is defined by Eqn. (21). After calculating the value of L for all values of $h_{Loop}$, the relationship between $h_{Loop}$ and $n_k$ is shown in FIG. 16.

Figure 17:
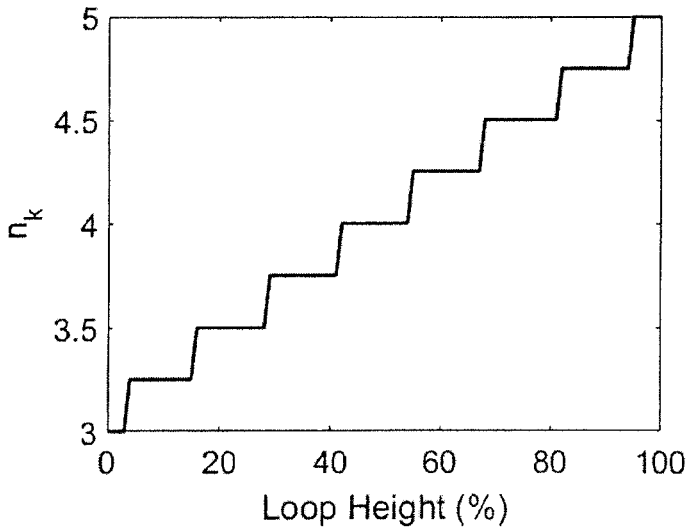
FIG. 17 is a chart showing the relationship between the normalized loop height measurement and $n_k$ using the relationship defined in Eqn. (29)

The estimation in Eqn. (28), however, can be prone to error because the value of L is predicated on the assumptions that the sensor is measuring the vertex of the loop, that the strip forms a catenary curve, and that the strip does not stretch after it leaves the casting rolls. Overall, the value of $n_k$ found in FIG. 16 may define a search window that results in the τ estimate overestimating the value of ΔT. One way to address this is by underestimating $n_k$ by a small amount and then using the τ estimate to search in the modified window for the true delay. In one example, $n_k$ may be underestimated by ¼ because the predominant dynamics of the thickness measurement are at the rotational frequency and twice the rotational frequency. This means that in a single roll revolution, the thickness profile has two peaks and two troughs. By underestimating $n_k$ by ¼ the information from the interval $[(n_k^*+3/4)T_R, (n_k^*+1)T_R]$ will be replaced with information from the interval $[(n_k^*-1/4)T_R, n_k^*T_R]$, where $n_k^*$ is the $n_k$ estimate produced using Eqn. (28). At most, this would replace one peak or one trough. Given that $n_kT_R$ is assumed to be close to the value of ΔT, it is reasonable to assume that any potential peak in the last quarter of the original interval would not be the true time delay. Rather, the information in the interval $[(n_k-1/4)T_R, n_kT_R]$, which is closer to $n_kT_R$, is a more reasonable candidate to contain the true delay time. The modified $n_k$ definition is then given by $$n_k = \text{round}(4L/L_k - 1)/4, \tag{29}$$

and its relationship to $h_{Loop}$ is shown in FIG. 17.

Figure 18:
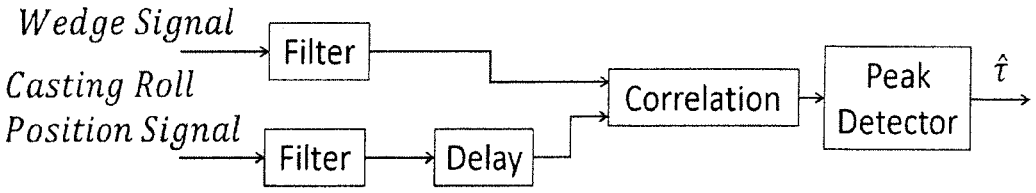
FIG. 18 is a diagram showing how the $\tau$ estimate is obtained by determining the delay value that creates the maximum correlation between the filtered wedge signal and a delayed and filtered casting roll position signal.

An objective of the τ estimation is to use a correlation-based delay estimation algorithm to search over the window $[n_kT_R, (n_k+1)T_R]$ to find the delay that results in the maximum correlation between the drive side position of the casting rolls and the measured wedge signal (defined as the drive side (DS) strip thickness measurement minus the operator side (OS) thickness measurement). The estimation algorithm is similar to the procedure described by FIG. 18. A sample interval of the wedge signal may be selected that begins at a given index and search for a delay value within $[n_kT_R, (n_k+1)T_R]$ that maximizes the Pearson's linear correlation coefficient between the casting roll position signal at the starting index minus the delay and the chosen wedge signal sample interval. The length of the sample intervals used to estimate z can affect the consistency of the estimation scheme. If too few points are used, the likelihood of an incorrect delay estimate increases. Conversely, more data points require more memory space and will take longer to process. It has been found that a sample of 1000 data points results in a consistent and accurate estimate while being relatively computationally efficient.

Figure 19:
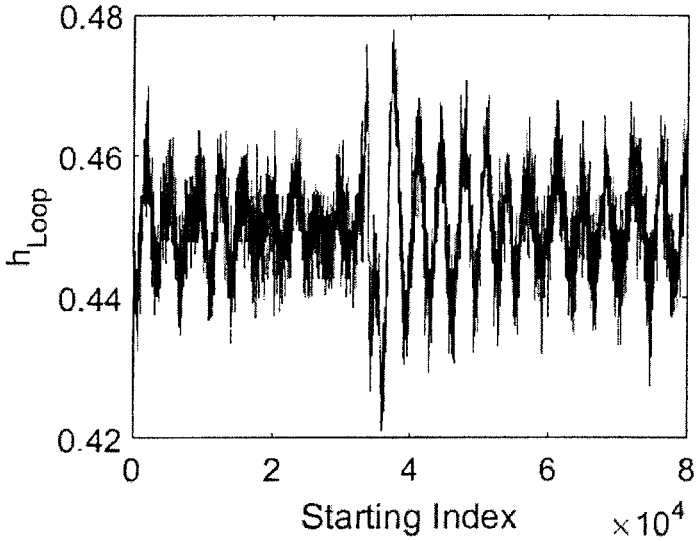
FIG. 19 is a chart showing the normalized loop height using dataset 1.

The time-delay estimation algorithm may be validated using two sets of experimental data. In the first dataset, the tilt of one of the casting rolls (the drive side position of the casting roll minus the operator side position of the casting roll) undergoes a step sequence and the wedge signal tracks the step changes. The normalized loop height remains close to 0.45 for the duration of the test, as shown in FIG. 19. This consistency results in a constant $n_K$ estimate of $n_K=4$ using the relationship in FIG. 17. This means that the z search window is $[4T_R, 5T_R]$ For this dataset, the rotational period of the casting rolls is $T_R=142$ samples.

Figure 20:
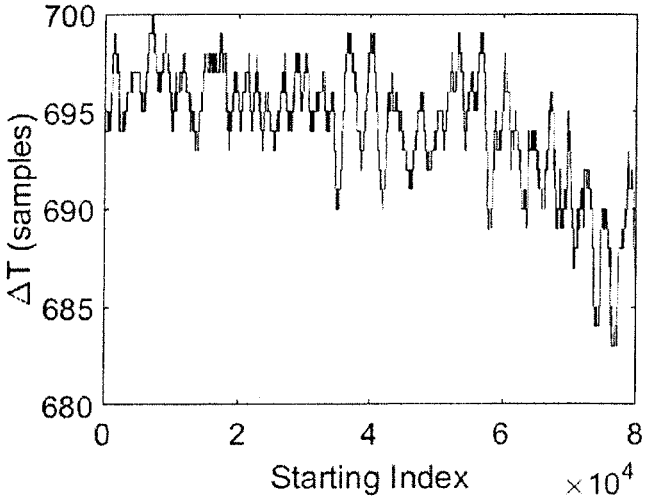
FIG. 20 is a chart showing the time delay estimate using dataset 1.
Figure 21:
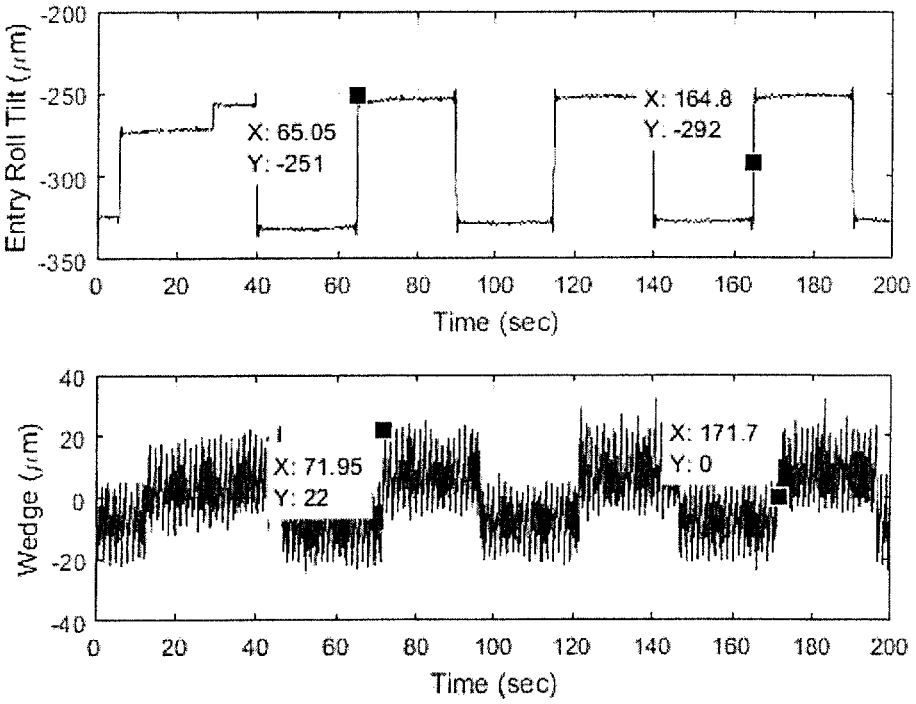
FIG. 21 shows two charts in which the time delay can be measured by comparing the time at which the steps occur in both the caster roll tilt signal (top chart) and the wedge measurement (bottom chart)

The time delay estimate is shown in FIG. 20. The estimate shows that the delay is consistently around 690 samples long, which is equivalent to 6.9 seconds. The consistency of the estimate is reasonable because the loop height is relatively constant and the total length of the strip between the casting rolls and the measurement location does not change significantly. Furthermore, the estimate may be manually verified by measuring the delay between the step sequence in the tilt signal versus the step sequence in the measured wedge signal. As shown in FIG. 21, the delay between the two signals is approximately 6.9 seconds which means the estimate of ΔT is accurate to within at least 10 samples.

Figure 22:
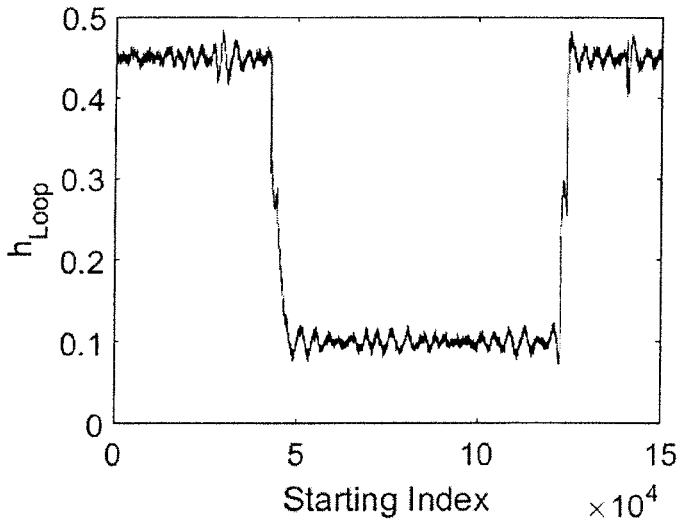
FIG. 22 is a chart showing the normalized loop height in dataset 2.
Figure 23:
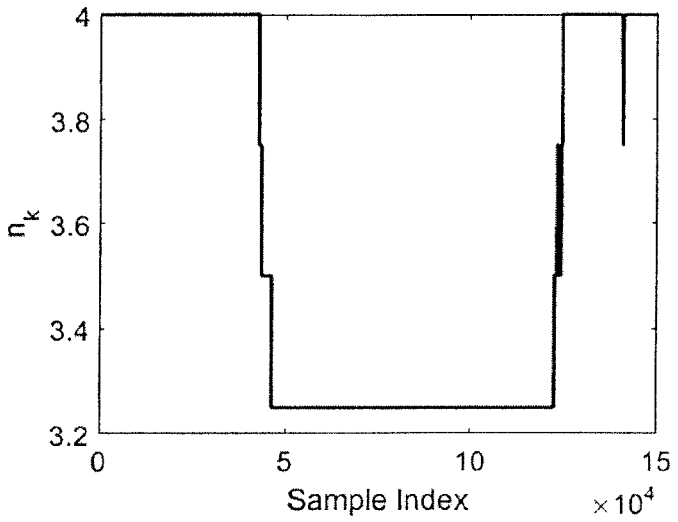
FIG. 23 is a chart showing the $n_k$ estimate based off of the loop height measurement using dataset 2.
Figure 24:
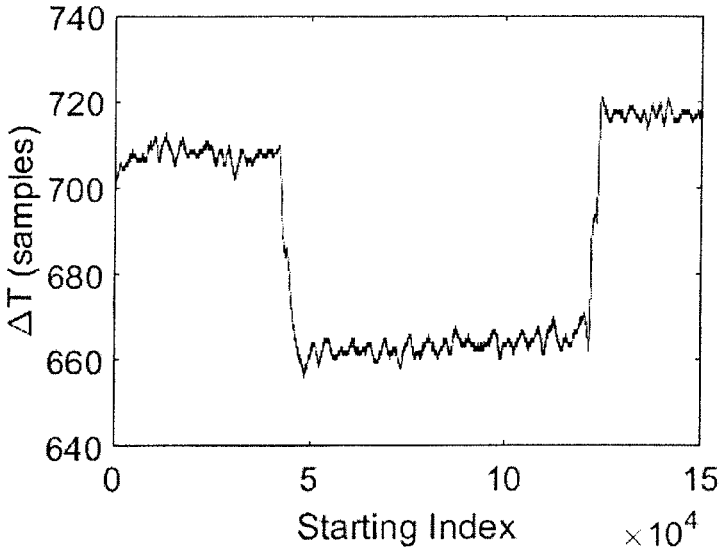
FIG. 24 is a chart showing the time delay estimate using dataset 2.

In dataset 2, the loop height is changed as shown in FIG. 22. This results in the $n_K$ estimate shown in FIG. 23 and subsequently the delay estimate shown in FIG. 24. In this case, ΔT changes significantly when loop height $h_{Loop}$ changes and the estimate of $n_K$ changes accordingly. Independently verifying the estimate based on dataset 2 is difficult because there are no easily identifiable features in the wedge and casting roll tilt signals, such as a step, that we can use as a reference for a manual delay measurement. However, the casting speed in dataset 2 is approximately 2 percent slower than in dataset 1. That means that the period of one revolution in dataset 2 is longer than the period of one revolution in dataset 1. In both datasets, there is an interval where loop height $h_{Loop}$ is approximately the same. In this interval, the estimate for ΔT is approximately 2 percent larger in dataset 2 than in dataset 1, which verifies that the time delay estimate is reasonable for dataset 2.

The foregoing delay estimation algorithm may be directly used in an ILC framework. In these simulations, a model of the twin roll casting process may provide an error by:

$$e(t,k)=-0.186u(t-1\tau,k-n_k)+D(t), \tag{30}$$

where $\tau=10$, $n_K=4$, and $$D(t)=\sin\left(\frac{2\pi}{T_R}t\right)$$

is all Relation-independent disturbance signal whose period is one iteration, that is $T_R=180$ samples. A control law in the same form as Eqn. (13), may be used where $$\begin{aligned} u(t,k+\bar{n}_k+1) &= Qu(t,k)+Ke(t+1+\hat{\tau},k+\hat{n}_k) \\ &= Qu(t,k)+K[0.186u(t+\hat{\tau}-\tau,k+\hat{n}_k-n_k)+D(t+1+\hat{\tau})]. \end{aligned} \tag{31}$$

If both $\hat{\tau}=\tau=10$ and $\hat{n}_k=n_k=4$, the system will be stable as long as there exists a Q>0 and K>0 that satisfy $$\|Q-0.186K\|<1.$$

Figure 25:
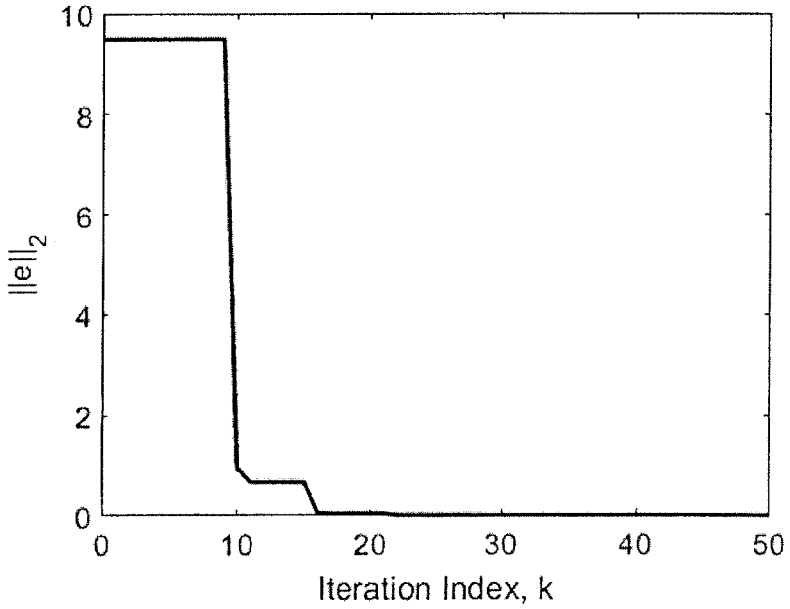
FIG. 25 is a chart showing the norm of the error signal converging to zero asymptotically when the estimated values of $n_k$ and $\tau$ are equal to their true values.
Figure 26:
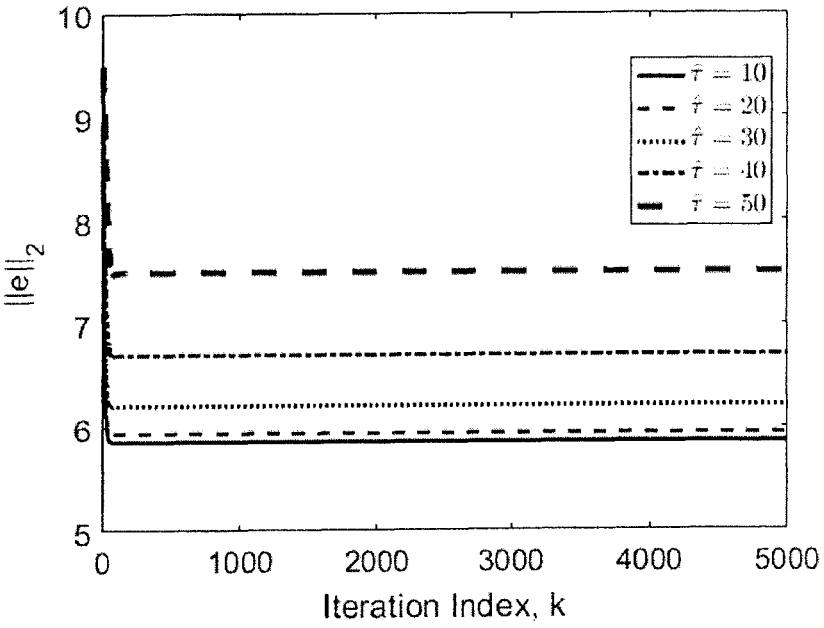
FIG. 26 is a chart showing the norm of the error signal still converging to a value that is less than the initial error when the estimated value $\tau$ differs from its true value by a small amount.
Figure 27:
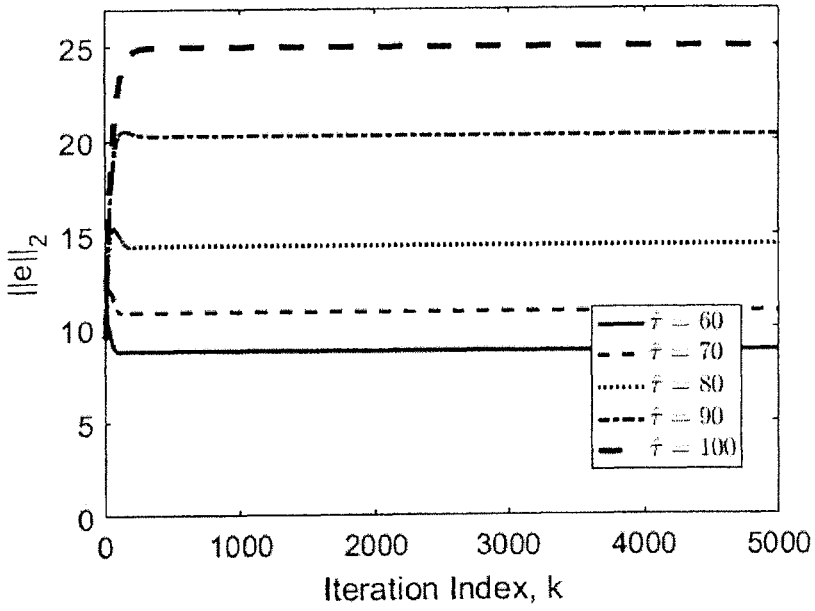
FIG. 27 is a chart showing the norm of the error signal converging to a value greater than its initial value when the estimated value $\tau$ differs from its true value by a large amount; and, FIG. 28 is a chart showing the norm of the error signal still converging to a value that is less than the initial error with the transient response changing when the estimated value $n_k$ differs from its true value by a small amount.

Choosing Q=1 means we may choose any K<10.75. Using K=5, the norm of the error signal converges to zero as shown in FIG. 25. If $\hat{\tau}\neq\tau$, but $\hat{n}_k=n_k=4$, the system will be stable as long as there exists a Q>0 and K>0 that satisfy $$(Q-0.185K\cos(10\omega))^2+(0.186K\sin(10\omega))^2<1,$$

for all $\omega\in\mathbb{R}$. Choosing a gain set of Q=0.7 and K=1 satisfies this criteria for all $\hat{\tau}\in[0, T_R]$ As FIG. 26 shows, the norm of the error signal in this case converges in all cases, but the final value is never zero. This is expected, because Q<1 and there are errors in the estimate of τ. Furthermore, as illustrated in FIG. 27 when $$\cos\left(\frac{\pi}{90}(\hat{\tau}-\tau)\right)<-\frac{0.186}{2}(1-0.7)$$

the asymptotic error is greater than the initial error. In these cases, the delay estimation error is too large for the ILC algorithm to improve system performance over open-loop operation. Note that in the case where $\hat{\tau}=100$, the angle of the −KG vector in FIG. 15 is $$\frac{2\pi}{180}(100-10)=\pi$$

radians, which places the −KG arrow on the positive real axis, pointing away from the origin. This is the worst possible case for the delay estimation.

Figure 28:
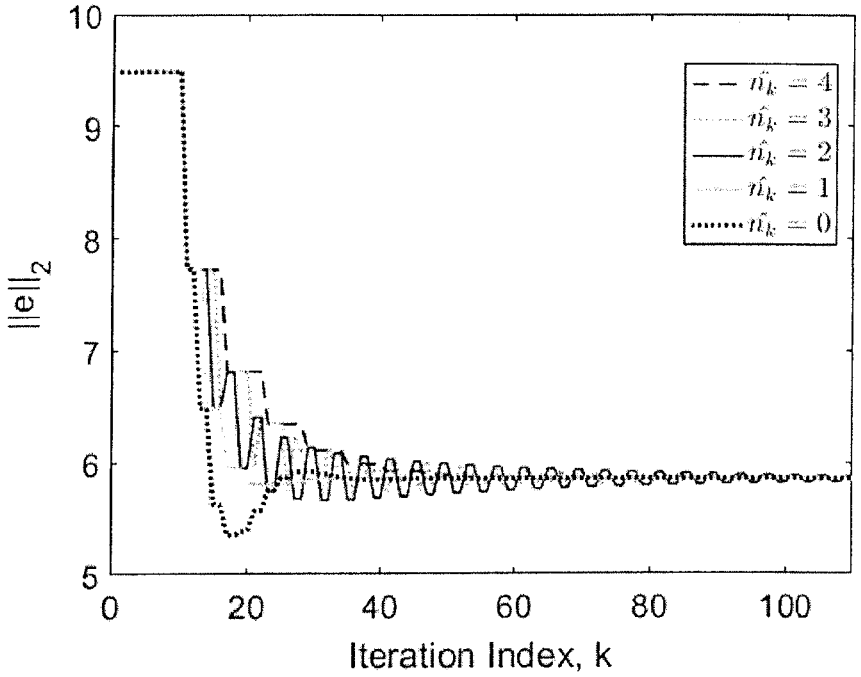

The $n_k$ estimate does not play a role in the asymptotic error. This is illustrated in FIG. 28, where for the gain set Q=0.7 and K=1, the norm of the error signal converges to the same steady-state value regardless of the $n_k$ estimate. The transient behavior of the system, however, varies drastically. Underestimating $n_k$ leads to faster convergence, but the behavior becomes oscillatory in the iteration-domain. This may or may not be acceptable for a given application.

In another example, the length L of the cast strip may be used to estimate the whole time delay ΔT, not just the iterative delay component $T_I$ In this example, length L and iterative time delay $T_I$ are determined using the method and Eqn. (28) is used as the $n_k$ estimate. However, instead of using a correlation-based delay estimation to find residual time delay τ, τ is estimated from the residual length L not accounted for by the iterative time delay as:

$$\tau=\frac{L-n_kC}{C}T_R$$

where C is the roller circumference. With this alternative method, the time delay is calculated with the roller circumference C, the rotational period $T_R$, and at least one measured parameter cast strip length, such as loop height. Additionally, the calculation of these components may be combined, so that the complete delay may be estimated in one calculation without separately calculating an iterative time delay and a residual time delay.

It is appreciated that any method described herein utilizing any iterative learning control method as described or contemplated, along with any associated algorithm, may be performed using one or more controllers with the iterative learning control methods and associated algorithms stored as instructions on any memory storage device. The instructions are configured to be performed (executed) using one or more processors in combination with a twin roll casting machine to control the formation of thin metal strip by twin roll casting. Any such controller, as well as any processor and memory storage device, may be arranged in operable communication with any component of the twin roll casting machine as may be desired, which includes being arrange in operable communication with any sensor and actuator. A sensor as used herein may generate a signal that may be stored in a memory storage device and used by the processor to control certain operations of the twin roll casting machine as described herein. An actuator as used herein may receive a signal from the controller, processor, or memory storage device to adjust or alter any portion of the twin roll casting machine as described herein.

To the extent used, the terms "comprising," "including," and "having," or any variation thereof, as used in the claims and/or specification herein, shall be considered as indicating an open group that may include other elements not specified. The terms "a," "an," and the singular forms of words shall be taken to include the plural form of the same words, such that the terms mean that one or more of something is provided. The terms "at least one" and "one or more" are used interchangeably. The term "single" shall be used to indicate that one and only one of something is intended. Similarly, other specific integer values, such as "two," are used when a specific number of things is intended. The terms "preferably," "preferred," "prefer," "optionally," "may," and similar terms are used to indicate that an item, condition or step being referred to is an optional (i.e., not required) feature of the embodiments. Ranges that are described as being "between a and b" are inclusive of the values for "a" and "b" unless otherwise specified.

While various improvements have been described herein with reference to particular embodiments thereof, it shall be understood that such description is by way of illustration only and should not be construed as limiting the scope of any claimed invention. Accordingly, the scope and content of any claimed invention is to be defined only by the terms of the following claims, in the present form or as amended during prosecution or pursued in any continuation application. Furthermore, it is understood that the features of any specific embodiment discussed herein may be combined with one or more features of any one or more embodiments otherwise discussed or contemplated herein unless otherwise stated.

What is claimed is:

1. A method of reducing periodic disturbances in a cast strip metal product in a twin roll casting system having a pair of counter-rotating casting rolls producing the cast strip at a nip between the casting rolls, the nip being adjustable by a casting roll controller, each roller having a circumference C and a rotational period $T_R$, an iterative learning controller, and a cast strip sensor, the method comprising:

measuring with the cast strip sensor at least one parameter of the cast strip at a time delay $T_D$ from when the cast strip exited the nip, where the time delay $T_D$ exceeds the rotational period $T_R$:

calculating a time delay estimate ΔT to compensate for time delay $T_D$, where the time delay estimate ΔT is calculated from the roller circumference C and the rotational period $T_R$ and at least one measured cast strip length parameter between when the cast strip exits the nip and when the cast strip is measured a time delay $T_D$ later;

providing the time delay estimate ΔT and the measured at least one parameter to the iterative learning controller;

generating control signals for the casting roll controller by the iterative learning controller based on the time delay estimate ΔT and the measured at least one parameter;

wherein the casting roll controller adjusts the nip in response to the control signals from the iterative learning controller to reduce the periodic disturbances.

2. The method of claim 1, wherein the at least one parameter comprises measurements of a thickness of the cast strip in intervals across a width of the cast strip.

3. The method of claim 1, wherein the casting roll controller further comprises a dynamically adjustable wedge controller and the nip is adjusted by the wedge controller in response to the control signals from the iterative learning controller.

4. The method of claim 1, wherein the casting rolls include expansion rings to adjust the nip and casting roll controller controls the expansion rings in response to the control signals from the iterative learning controller.

5. The method of claim 1, wherein the at least one cast strip length parameter comprises cast strip loop height.

6. The method of claim 5, wherein the step of calculating time delay estimate ΔT further comprises calculating a length L of cast strip between the nip and a portion of the cast strip where the at least one parameter is measured including the cast strip loop height.

7. The method of claim 5, wherein the step of calculating time delay estimate ΔT further comprises calculating a length L of cast strip between the nip and a portion of the cast strip where the at least one parameter is measured including the cast strip loop height, and wherein time delay estimate ΔT further comprises an iterative delay $T_I$ comprising a multiple n of the rotational period $T_R$ where the multiple n is the greatest natural number such that the product of n and C is less than L, and a residual delay τ, where τ is estimated based on the difference of the product of n and C subtracted from L multiplied by the rotational period $T_R$ divided by L.

8. The method of claim 1, wherein the periodic disturbances being reduced occur at a frequency equal to or greater than a frequency corresponding to the rotational period $T_R$.

9. The method of claim 1, wherein the periodic disturbances comprise casting periodic disturbances.

10. The method of claim 1, wherein the step of generating control signals for the casting roll controller by the iterative learning controller further comprises generating the control signals based on the time delay estimate ΔT, the measured at least one parameter, and a previous iteration of the control signals.

11. A twin roll casting system, comprising:

a pair of counter-rotating casting rolls having a nip between the casting rolls and capable of delivering cast strip downwardly from the nip, the nip being adjustable, each roller having a circumference C and a rotational period $T_R$;

a casting roll controller configured to adjust the nip between the casting rolls in response to control signals;

a cast strip sensor capable of measuring at least one parameter of the cast strip, where a cast strip of length L exists between the nip and the cast strip sensor, the length L being greater than circumference C; and an iterative learning controller coupled to the cast strip sensor to receive strip measurement signals from the cast strip sensor and coupled to the casting roll controller to provide control signals to the casting roll controller, the iterative learning controller including an iterative learning control algorithm to generate the control signals based on the strip measurement signals and a time delay estimate ΔT representing an elapsed time from the cast strip exiting the nip to being measured by the cast strip sensor, where the time delay estimate ΔT is calculated from the roller circumference C and the rotational period $T_R$ and at least one measured cast strip length parameter between when the cast strip exits the nip and when the cast strip is measured a time delay $T_D$ later.

12. The system of claim 11, wherein the at least one parameter comprises measurements of a thickness of the cast strip in intervals across a width of the cast strip.

13. The system of claim 11, wherein the casting roll controller further comprises a dynamically adjustable wedge controller and the nip is adjusted by the wedge controller in response to the control signals from the iterative learning controller.

14. The system of claim 11, wherein the casting rolls include expansion rings to adjust the nip and casting roll controller controls the expansion rings in response to the control signals from the iterative learning controller.

15. The system of claim 11, wherein the at least one measured cast strip length parameter comprises cast strip loop height.

16. The system of claim 15 wherein the step of calculating time delay estimate ΔT further comprises calculating a length L of cast strip between the nip and a portion of the cast strip where the at least one parameter is measured including the cast strip loop height.

17. The system of claim 15 wherein the step of calculating time delay estimate ΔT further comprises calculating a length L of cast strip between the nip and a portion of the cast strip where the at least one parameter is measured including the cast strip loop height, and wherein time delay estimate $\Delta T$ further comprises an iterative delay $T_I$ comprising a multiple n of the rotational period $T_R$ where the multiple n is the greatest natural number such that the product of n and C is less than L, and a residual delay $\tau$, where $\tau$ is estimated based on the difference of the product of n and C subtracted from L multiplied by the rotational period $T_R$ divided by L.

* * * * *